US007874466B2

(12) United States Patent
McConville et al.

(10) Patent No.: US 7,874,466 B2
(45) Date of Patent: Jan. 25, 2011

(54) PACKAGE COMPRISING PUSH-PULL CLOSURE AND SLIT VALVE

(75) Inventors: Su Yon McConville, Mason, OH (US); Henry Dianxi Ren, Cincinnati, OH (US); Nicholas Arthur Ruebusch, Fort Thomas, KY (US); Alfredo Pagan, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 114 days.

(21) Appl. No.: 11/982,953

(22) Filed: Nov. 6, 2007

(65) Prior Publication Data

US 2008/0230569 A1 Sep. 25, 2008

Related U.S. Application Data

(60) Provisional application No. 60/857,301, filed on Nov. 7, 2006.

(51) Int. Cl.
*B65D 25/40* (2006.01)

(52) U.S. Cl. ..... 222/494; 220/203.18

(58) Field of Classification Search ..... 222/494, 222/9, 490, 492, 495–499, 94–107, 154.1; 220/203.11, 23.15, 203.18, 203.15
See application file for complete search history.

(56) References Cited

U.S. PATENT DOCUMENTS

| | | | |
|---|---|---|---|
| 4,133,457 | A | 1/1979 | Klassen |
| 4,169,548 | A | 10/1979 | Bond |
| 4,314,656 | A | 2/1982 | Kessler |
| 4,420,101 | A | 12/1983 | O'Neill |
| 4,553,686 | A | 11/1985 | Dougherty |
| 4,620,665 | A | 11/1986 | McSherry |
| 4,667,854 | A | 5/1987 | McDermott et al. |
| 4,767,034 | A | 8/1988 | Cramer |
| 4,917,267 | A | 4/1990 | Laverdure |
| 4,941,598 | A * | 7/1990 | Lambelet, Jr. et al. |

(Continued)

FOREIGN PATENT DOCUMENTS

| | | |
|---|---|---|
| DE | 10213125 | 10/2003 |

(Continued)

OTHER PUBLICATIONS

International Search Report, PCT/IB2007/054528, dated Mar. 7, 2008 (7 pages).

(Continued)

*Primary Examiner*—Lien T Ngo
(74) *Attorney, Agent, or Firm*—James C. Vago; Brian M. Bolam

(57) ABSTRACT

Packages for containing and dispensing consumer products comprise a push-pull closure connected to a bottle and having a dispensing opening covered by a slit valve. The combination of a push-pull closure and a slit valve results in a package that easily dispenses a liquid consumer product, while guarding against leakage of the consumer product from the package, especially during transportation and storage of the product, particularly when the package is a tottle package. The push-pull closure of the present package is simple to open and can also be easily closed with the use of only one hand, especially by pressing the closure against a flat surface, such as a shower wall or shelf.

7 Claims, 7 Drawing Sheets

U.S. PATENT DOCUMENTS

| | | | |
|---|---|---|---|
| 5,044,529 | A | 9/1991 | Campbell |
| 5,067,821 | A | 11/1991 | Young |
| 5,147,072 | A | 9/1992 | Dirksing |
| 5,213,236 | A | 5/1993 | Brown et al. |
| 5,292,203 | A | 3/1994 | Whitman |
| 5,305,920 | A | 4/1994 | Reiboldt et al. |
| 5,339,995 | A | 8/1994 | Brown et al. |
| 5,370,284 | A | 12/1994 | Dirksing |
| 5,377,877 | A | 1/1995 | Brown et al. |
| 5,409,144 | A | 4/1995 | Brown |
| 5,421,488 | A | 6/1995 | Ehrbar |
| 5,439,143 | A | 8/1995 | Brown et al. |
| 5,477,994 | A | 12/1995 | Feer et al. |
| 5,505,346 | A | 4/1996 | Smith |
| 5,615,809 | A | 4/1997 | Feer et al. |
| 5,655,687 | A | 8/1997 | Fitten et al. |
| 5,819,984 | A | 10/1998 | Krueger |
| 5,839,614 | A | 11/1998 | Okawa et al. |
| 5,979,688 | A | 11/1999 | Stodd |
| 6,050,435 | A | 4/2000 | Bush et al. |
| 6,152,324 | A | 11/2000 | Baudin |
| 6,179,166 | B1 | 1/2001 | Dallas, Jr. |
| 6,186,374 | B1 | 2/2001 | Gross |
| 6,199,725 | B1 | 3/2001 | Garibaldi |
| 6,279,783 | B1 | 8/2001 | Brown et al. |
| 6,290,108 | B1 | 9/2001 | Gross |
| 6,298,554 | B1 | 10/2001 | Fuchs |
| 6,321,947 | B2 * | 11/2001 | Gross et al. |
| 6,427,874 | B2 | 8/2002 | Brown et al. |
| 6,450,375 | B1 | 9/2002 | Hins et al. |
| 6,543,652 | B1 | 4/2003 | Kelder et al. |
| 6,616,016 | B2 | 9/2003 | Hicks et al. |
| 6,672,487 | B1 | 1/2004 | Lohrman |
| 6,786,363 | B1 | 9/2004 | Lohrman |
| 6,832,706 | B2 | 12/2004 | Hearld et al. |
| 6,951,295 | B1 | 10/2005 | Gaus et al. |
| D587,122 | S | 2/2009 | Herstol et al. |
| D609,101 | S | 2/2010 | Herstol et al. |
| 2001/0025862 | A1 | 10/2001 | Brown et al. |
| 2002/0130139 | A1 | 9/2002 | Shiraishi et al. |
| 2002/0158083 | A1 | 10/2002 | Brown et al. |
| 2002/0162839 | A1 | 11/2002 | Stull et al. |
| 2003/0029890 | A1 | 2/2003 | Olechowski et al. |
| 2003/0098312 | A1 | 5/2003 | Hakim |
| 2003/0189065 | A1 | 10/2003 | Stull et al. |
| 2004/0200738 | A1 | 10/2004 | Rovelli et al. |
| 2004/0251275 | A1 | 12/2004 | Arai |
| 2005/0029219 | A1 | 2/2005 | Taber et al. |
| 2005/0056652 | A1 | 3/2005 | Cezeaux |
| 2005/0155991 | A1 | 7/2005 | Jackman |
| 2005/0250658 | A1 | 11/2005 | Putman et al. |
| 2006/0049208 | A1 | 3/2006 | Daansen |
| 2007/0289651 | A1 | 12/2007 | Brown et al. |

FOREIGN PATENT DOCUMENTS

| | | | |
|---|---|---|---|
| EP | 111798 | | 9/1985 |
| EP | 314285 | | 5/1989 |
| EP | 0791542 | A2 | 8/1997 |
| EP | 0733559 | | 11/1998 |
| EP | 0885813 | A2 | 12/1998 |
| EP | 1321375 | | 6/2003 |
| EP | 1531130 | A1 | 5/2005 |
| EP | 1537990 | A2 | 6/2005 |
| EP | 1645520 | | 4/2006 |
| EP | 1671894 | A1 | 6/2006 |
| EP | 1676605 | | 7/2006 |
| EP | 1676783 | | 7/2006 |
| GB | 2 330 577 | A | 4/1999 |
| GB | 2230577 | A | 4/1999 |
| JP | 08244814 | | 9/1996 |
| JP | 09165062 | | 6/1997 |
| JP | 10016998 | | 1/1998 |
| JP | 10024951 | | 1/1998 |
| JP | 10152154 | | 6/1998 |
| JP | 10157754 | | 6/1998 |
| JP | 10218205 | | 8/1998 |
| JP | 10236498 | | 9/1998 |
| JP | 10264954 | | 10/1998 |
| JP | 11011502 | | 1/1999 |
| JP | 11059750 | | 3/1999 |
| JP | 11091817 | | 4/1999 |
| JP | 11105910 | A | 4/1999 |
| JP | 10139080 | | 5/1999 |
| JP | 11310279 | | 11/1999 |
| JP | 2000272622 | | 10/2000 |
| JP | 2001063779 | | 3/2001 |
| JP | 2001322691 | | 11/2001 |
| JP | 2002337911 | | 11/2002 |
| JP | 2003063576 | | 3/2003 |
| JP | 2003144032 | | 5/2003 |
| JP | 2003146381 | | 5/2003 |
| JP | 2003182750 | | 7/2003 |
| JP | 2003182750 | A2 | 7/2003 |
| JP | 2003191974 | | 7/2003 |
| JP | 2003267480 | | 8/2003 |
| JP | 2003289935 | | 10/2003 |
| JP | 2004161343 | | 6/2004 |
| JP | 2004189335 | | 7/2004 |
| JP | 2004210323 | | 7/2004 |
| JP | 2004250018 | | 9/2004 |
| JP | 2005029238 | | 2/2005 |
| JP | 2005126120 | | 5/2005 |
| JP | 2005153950 | | 6/2005 |
| JP | 2006001570 | | 1/2006 |
| JP | 2006151482 | | 6/2006 |
| JP | 2006151482 | A2 | 6/2006 |
| WO | WO 91/03403 | | 3/1991 |
| WO | WO 94/05425 | | 3/1994 |
| WO | WO 94/29184 | | 12/1994 |
| WO | WO 98/14387 | | 4/1998 |
| WO | WO 98/58847 | | 12/1998 |
| WO | WO 98/58847 | A1 | 12/1998 |
| WO | WO 99/10247 | | 3/1999 |
| WO | WO 99/15759 | | 4/1999 |
| WO | WO 99/23029 | | 5/1999 |
| WO | WO 00/21841 | | 4/2000 |
| WO | WO 00/75032 | | 12/2000 |
| WO | WO 01/00498 | | 1/2001 |
| WO | WO 02/08080 | | 1/2002 |
| WO | WO 2002096770 | | 5/2002 |
| WO | WO 2003078270 | A1 | 9/2003 |
| WO | WO 03/105635 | A1 | 12/2003 |
| WO | WO 2005075308 | | 8/2005 |
| WO | WO 2006/009984 | A3 | 1/2006 |
| WO | WO 2006/083392 | | 8/2006 |

OTHER PUBLICATIONS

Canadian Official Action dated Jan. 22, 2010, Application No. 2,665,917 (4 pages).

http://www.dialsoap.com/dial_for_men.html, 2 pages.

http://www.dialsoap.com/3D-bar-soap.html, Dial for Men the Ultimate Clean Hydrating Body Scrub, 5 pages.

Global New Products Database, http://www.gnpd.com. USA, Feb. 2006, Dial for Men Recharge Hydrating Body Wash, 2 pages.

Global New Products Database, http://www.gnpd.com. Gillette, Singapore, Jul. 2000, Arctic Ice Deodorant, Gillette Clear Gel Antiperspirant Deodorant, 1 page.

http://catalogue.seaquistclosures.eu/ProductDetails.asnx?productid=428, 25 mm Frost™SimpliSqueeze®, print date Mar. 1, 2010 (2 pages).

http://catalogue.seaquistclosures.eu/ProductDetails.aspx?productid=431, 28-400 SimpliSqueeze®, print date Mar. 1, 2010 (2 pages).
http://catalogue.scaquistclosures.eu/ProductDetails.aspx?productid=432, 28-400 Simplicity SimpliSqueeze®, print date Mar. 1, 2010 (2 pages).
http://catalogue.seaquistclosures.eu/ProductDetails.aspx?productid=433,&variationid=640, 29 mm SimpliSqueeze®, print date Mar. 1, 2010 (2 pages).
http://catalogue.seaquistclosures.eu/ProductDetails.aspx?productid=434, 31 mm SimpliSqueeze®, print date Mar. 1, 2010 (2 pages).
http://catalogue.seaquistclosures.eu/ProductDetails.aspx?productid=436, 32 mm SimpliSqueeze®, print date Mar. 1, 2010 (2 pages).
http://catalogue.seaquistclosures.eu/ProductDetails.asnx?productid=437, 32 mm SimpliSqueeze®, print date Mar. 1, 2010 (2 pages).
http://catalogue.seaquistclosures.eu/ProductDetails.asnx?productid=438, 32 mm SimpliSqueeze®, print date Mar. 1, 2010 (2 pages).
http://catalogue.seaquistclosures.eu/ProductDetails.asnx?productid=609, 28 mm Push-Pull, print date Mar. 1, 2010 (2 pages).
http://catalogue.seaquistclosures.eu/ProductDetails.asnx?productid=612, 32 mm Push-Pull, print date Mar. 1, 2010 (2 pages).
http://catalogue.seaquistclosures.eu/ProductDetails.asnx?productid=614, 25,5 mm Squeeze & Turn, print date Mar. 1, 2010 (2 pages).
http://catalogue.seaquistclosures.eu/ProductDetails.asnx?productid=624, 25,5 mm Squeeze & Turn, print date Mar. 1, 2010 (2 pages).
http://catalogue.seaquistclosures.eu/ProductDetails.aspx?productid=628, 12,9 mm Push & Turn, print date Mar. 1, 2010 (2 pages).
http://catalogue.seaquistclosures.eu/ProductDetails.aspx?productid=629, 18 mm Push & Turn, print date Mar. 1, 2010 (2 pages).
http://catalogue.seaquistclosures.eu/ProductDetails.aspx?productid=637, 40 mm Push & Turn, print date Mar. 1, 2010 (2 pages).
http://catalogue.seaquistelosures.eu/ProductDetails.aspx?productid=848, 24-415 SimpliSqueeze®, print date Mar. 1, 2010 (2 pages).
http://catalogue.seaquistclosures.eu/ProductDetails.aspx?productid=633, 28 mm Push & Turn, print date Mar. 1, 2010 (2 pages).
http://catalogue.seaquistelosures.eu/ProductDetails.aspx?productid=850, 28 mm SimpliSqueeze®, print date Mar. 1, 2010 (2 pages).

* cited by examiner

PACKAGE COMPRISING PUSH-PULL CLOSURE AND SLIT VALVE

CROSS REFERENCE TO RELATED APPLICATIONS

This application claims the benefit of U.S. Provisional Application No. 60/857,301 filed Nov. 7, 2006.

FIELD OF THE INVENTION

The present invention relates to packages for containing and dispensing consumer products comprising a push-pull closure and a slit valve.

BACKGROUND OF THE INVENTION

Liquid consumer products are contained in a wide variety of packages. Liquid personal care products are contained in bottles, inverted bottles (i.e. "tottles"), jars, and the like. Such packages typically have a flip-top closure, twist-top closure, or screw-top closure system. Dishwashing liquids are often contained in packages having push-pull closures. Food condiments such as ketchup, mayonnaise, mustard, and the like are often packaged in bottles having twist-top closure, flip-top closures, and the like. Each of these packages include plastic bottles that can dispense the products upon squeezing the side walls of the bottle.

Recently, food condiments have been packaged in a tottle package having a flip-top closure with a slit valve covering the dispensing opening of the package. The slit valve acts to prevent the product from flowing out of the package unless force is exerted on the side walls of the bottle of the package by squeezing. Dispensing of the product can therefore be more accurately controlled and unwanted dispensing of the product can be prevented.

Liquid personal care products, such as liquid body washes (i.e. shower gels), have historically been packaged in upright bottles having flip-top closures. More recently, liquid body washes are being contained in tottle packages. Tottle packages are beneficial since the package rests on its dispensing cap, thereby allowing gravity to pull the liquid composition towards the opening to facilitate easier dispensing when the package is opened for dispensing the composition.

Problems, however, arise with existing packages for liquid consumer products with respect to preventing unwanted leakage of composition while maintaining easier dispensing of the product. During shipment and during storage of the consumer product on the shelf in a retail store, many times the closure will be inadvertently opened and product can then leak out of the package. This can be a significant problem for tottle packages with flip-top closures, as such closures typically require little force to flip open the closure for consumer convenience. However, the ease of opening such flip-top closures tends to often result in product leakage from the package due to inadvertent opening during transportation or accidental dropping of the package.

Additional problems arise with respect to flip-top closures as well as other closures such as twist-up closures and screw-top closures. Such closures typically require the consumer to use two hands to securely open and close such closures. This can be extremely inconvenient, especially when the consumer product being dispensed is a liquid body wash or hair shampoo. When a consumer uses a liquid body wash, he typically dispenses the body wash into his hand or onto a body wash puff. The consumer cannot conveniently utilize his hand containing the product to close product package. The consumer therefore needs a package that can be easily closed with one hand, either by holding the package in one hand and manipulating the closure with the same hand, or by holding the package in one hand and pressing the package against a surface, such as a shower wall.

Flip-top closure packages are difficult to hold and close with one hand, unless the user tries to press the package against a surface such as a shower wall. In closing such a package by pressing against a surface, it can be difficult to position the package at the correct angle to successfully close the flip-top closure and if the package is not positioned at the correct angle, the hinge of the flip-top closure is susceptible to breakage. Twist-top and screw-top closures are very difficult to hold and close with one hand, as such closures typically require the user to hold the bottle with one hand, while twisting the closure with the other hand.

There thus remains a desire to develop a package that easily dispenses a liquid consumer product, prevents unwanted leakage of the product, and can be easily closed with the use of only one hand.

SUMMARY OF THE INVENTION

The present invention relates to a package for a consumer product, preferably a liquid consumer product, wherein the package comprises a push-pull closure connected to a bottle and a dispensing opening covered by a slit valve through which the consumer product is dispensed. The combination of a push-pull closure and a slit valve results in a package that easily dispenses a liquid consumer product, while guarding against leakage of the consumer product from the package, especially during transportation and storage of the product, particularly when the package is a tottle package. The push-pull closure of the present package is simple to open and can also be easily closed with the use of only one hand, especially by pressing the closure against a flat surface, such as a shower wall or shelf.

DETAILED DESCRIPTION OF THE INVENTION

Figure 1:
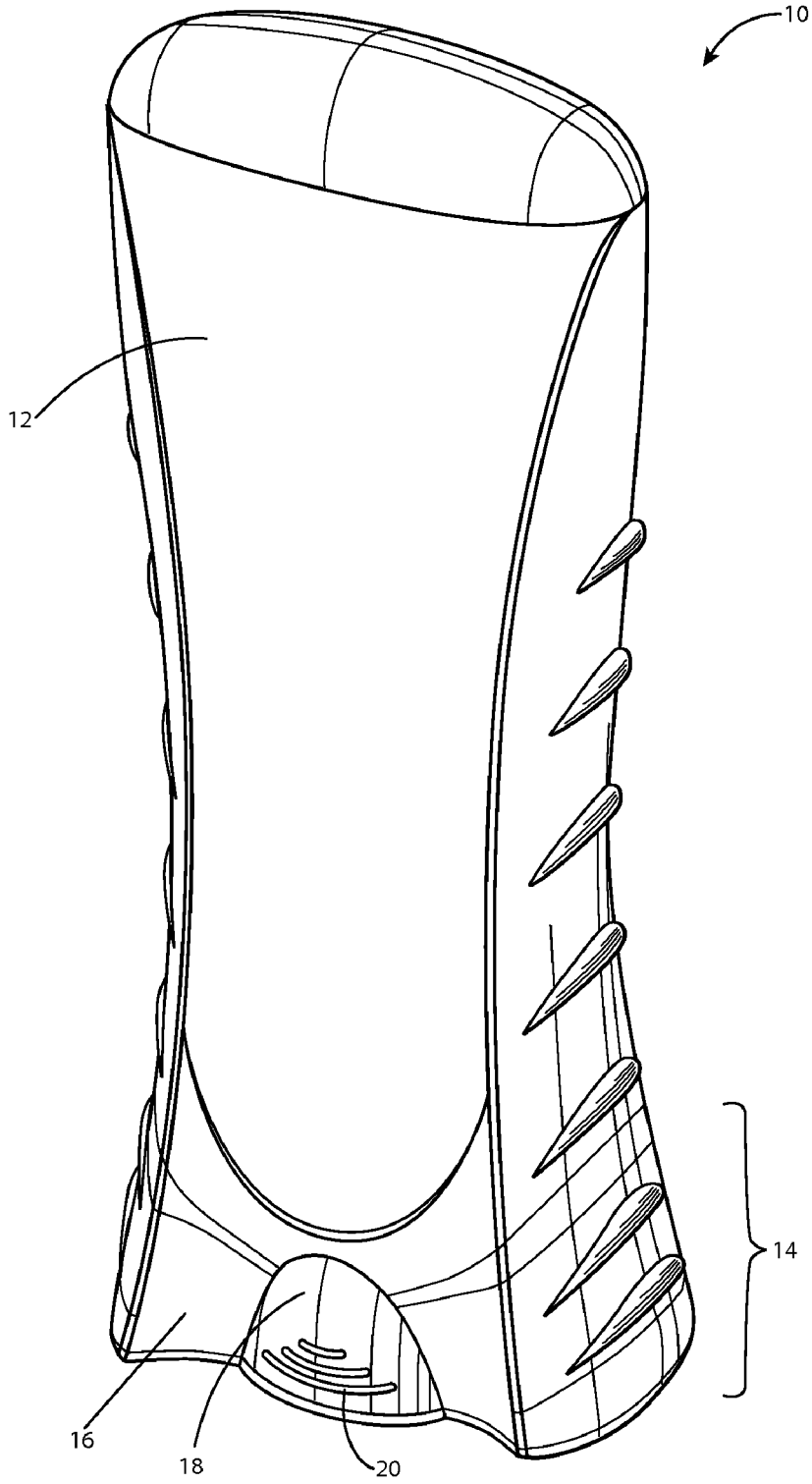
FIG. 1 is a perspective view of a package of the present invention.

As used herein, the term "tottle" means a package comprising a bottle and a closure attached to the bottle, wherein the package is designed to rest on its closure. Many shampoos, hair conditioners, shaving lotions, body washes, in-shower body moisturizers, and other products used in the shower or bath are contained in tottles. Many food condiments are also contained in tottles, such as ketchup, mayonnaise, mustard, and the like. In one embodiment, the package of the present invention is a tottle package.

Push-Pull Closure

The present package comprises a push-pull closure that comprises a slidable cap that seals (i.e. closes) and unseals (i.e. opens) the dispensing opening of the package. The push-pull closure will preferably further comprise a base member comprising a guide wall. The slidable cap preferably comprises a slide column wall that engages a guide wall of the base member. The slide column wall of the slidable cap is then able to slide along the guide wall of the base member, which serves to align and stabilize the slidable cap during use. In one embodiment, the slide column wall of the slidable cap comprises a raised bead line around the inner surface of the slide column wall. In such embodiment, the guide wall of the base member can comprise two parallel recessed channels that can receive the raised bead line of the slide column wall. In this respect, the slidable cap can be slid into at least two set positions, an open position and a closed position. Depending upon the consumer product being dispensed, it may be desirable to have three, four or more set positions of the slidable cap, each imposing varying degrees of resistance to the product being dispensed from the package.

The base member of the push-pull closure can further comprise a snap-fit or threaded connecting structure to secure the push-pull closure to the bottle of the package.

The push-pull closure can further optionally comprise a shroud, wherein the shroud can cover the functional features of the closure and provide an aesthetically-pleasing design for the package.

The push-pull closure can optionally further comprise a diffuser as discussed in more detail below.

The base member and shroud of the push-pull closure can be molded as separated pieces or can be molded as a single unitary piece.

Slit Valve

The present package further comprises a slit valve. The slit valve covers the dispensing opening of the package. The slit valve is made of a relatively flexible material, such as for instance silicone rubber, polyvinyl chloride, urethane, ethylene vinyl acetate, a styrene-butadiene copolymer, and the like. Upon placing the container in an upside-down position and upon application of a squeezing force on the package, the slit valve opens due to the increased pressure and a dispensing of the liquid consumer product through the slit occurs. Upon removal of the squeezing force, the slit closes and the liquid consumer product is prevented from flowing out of the container. The stiffness of the slit valve is sufficient to prevent the slit from opening under the hydrostatic pressure of the liquid consumer product when the container is placed in an inverted position.

The push-pull closure of the present invention prevents opening of the slit during storage or transportation of the container (due to unintentionally applied squeezing forces or shocks due to falling) when the push-pull closure is in the closed position.

The slit valve can be located in various pieces of the push-pull closure or in the bottle of the package of the present invention, so long as the slit valve covers the dispensing opening of the package. In one embodiment, the slit valve is located in the slidable cap of the push-pull closure. In this respect, the slidable cap comprises a dispensing opening that is covered by the slit valve. The slit valve therefore moves along with the slidable cap. In this embodiment, the slit valve is held into place via a retaining ring located inside a valve housing of the slidable cap.

Diffuser

The package of the present invention can optionally further comprise a diffuser. A diffuser is especially preferred if the package is utilized for containing a shear-thinning liquid composition (e.g. a non-Newtonian liquid composition) or for containing a composition that requires some degree of mixing or agitation before use. The diffuser can be incorporated into the closure of the package, the bottle of the package, or both.

As used herein, a diffuser is a rigid structure (vs. a flexible structure such as a slit valve) that can reduce the velocity and increase the static pressure of a liquid composition as it is dispensed from the package of the present invention. The diffuser therefore imparts shear upon the composition as it is being dispensed from the package.

The diffuser can also act as a mixing unit within the closure of the package. In this respect, the diffuser can comprise movable parts (e.g. movable impellers) or can have fixed, static parts (e.g. fixed wall(s) having a plurality of openings in the wall(s)). The openings can have a variety of geometries, depending upon the consumer product being dispensed from the package.

In one embodiment, the diffuser is in the shape of a funnel, the funnel having a plurality of openings near the base of the funnel that allow the composition to flow through the diffuser.

When present, the diffuser is preferably positioned within the package such that the liquid composition, as it is being dispensed, flows through the diffuser before it flows through the slit valve of the package. As a result, the liquid composition, if it is a shear-thinning composition, will have a lower viscosity when it contacts the slit valve, making it easier to dispense through the slit valve.

Bottle

The bottle of the present package can be provided in a variety of forms or shapes. The bottle can be made of a plastic material. Examples of suitable plastic materials include high density polyethylene ("HDPE"), low density polyethylene ("LDPE"), polyethylene terephthalate ("PET"), polypropylene ("PP"), polyvinyl chloride, polycarbonate, nylon, and fluorinated ethylene propylene. The bottle can be made via a number of various processes known in the art, such as blow molding, injection molding, and the like. Preferred bottles of the present invention are made of HDPE or PP via an extrusion blow molding process, or PET via an injection blow molding process.

The bottle comprises an opening through which the contained composition can be dispensed. The bottle will also typically comprise an attachment structure to which the push-pull closure can be attached, such as screw-threads, snap-fit collar, or the like.

Example

The following is one embodiment of the present invention, as depicted in the drawings. While this describes one embodiment of the present invention, it would be apparent to those skilled in the art that various changes and modifications can be made without departing from the spirit and scope of the invention. It is therefore intended to cover in the appended claims all such changes and modifications that are within the scope of this invention.

Figure 2:
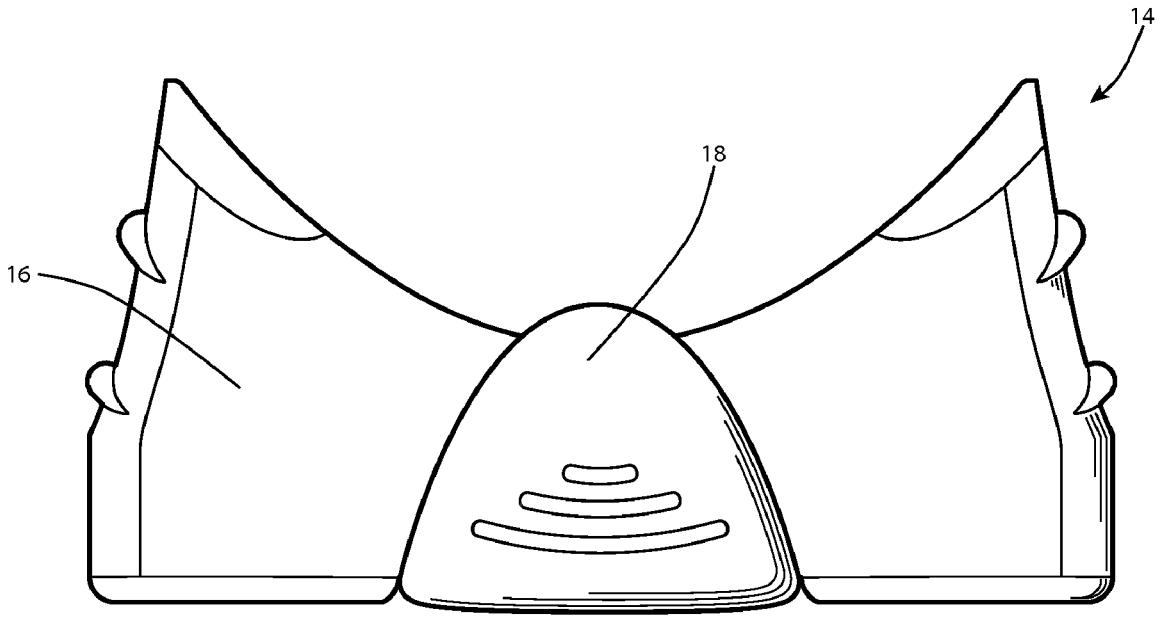
FIG. 2 is a front view of a push-pull closure of the present invention in a closed position, the back view being a mirror image thereof.
Figure 7:
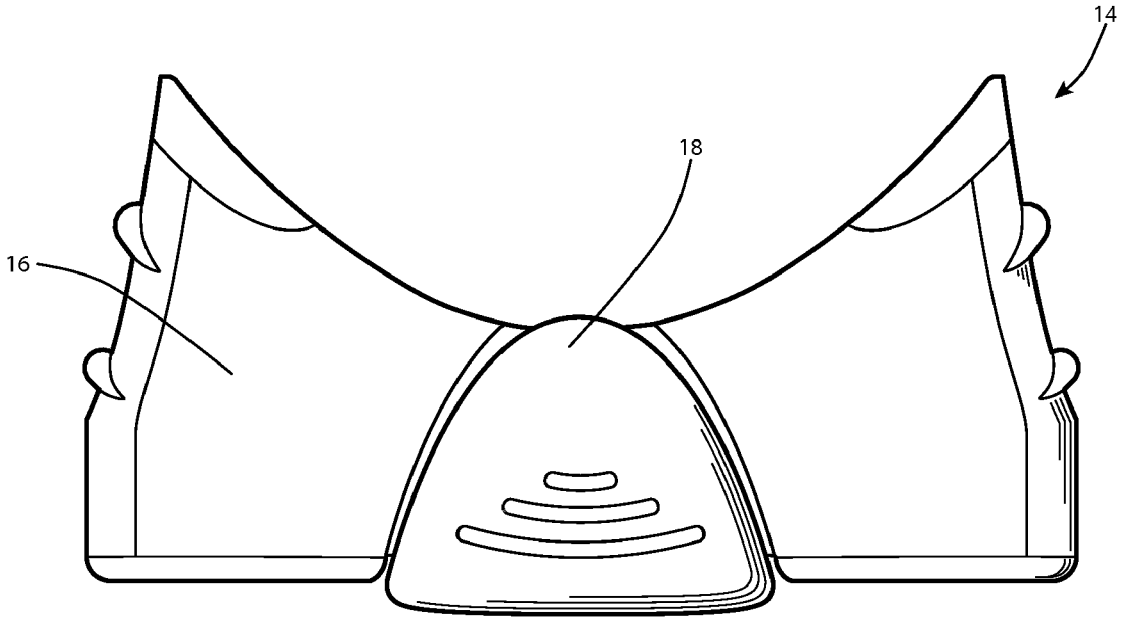
FIG. 7 is a front view of a push-pull closure of the present invention in an open position, the back view being a mirror image thereof.

FIG. 1 shows a perspective view of a package 10 of the present invention, which is a tottle package, comprising a bottle 12 attached to a push-pull closure 14. The push-pull closure 14 comprises a shroud 16 and a slidable cap 18 that can be pulled to open the package (as shown in FIG. 7) for dispensing the consumer product contained therein and pushed to close the package (as shown in FIG. 2) for storing the consumer product contained therein. The front and back sides of the slidable cap 18 are half-oval in shape and have ridges 20 protruding from the surface of the sides of the slidable cap 18 so that a consumer can easily grasp the front and back sides of the slidable cap to slide the slidable cap from a closed position (as shown in FIG. 2) to an open position (as shown in FIG. 7), and vice versa.

FIG. 2 is a front view of a push-pull closure 14 of the present invention comprising a shroud 16 and slidable cap 18, wherein the closure is in a closed position.

Figure 3:
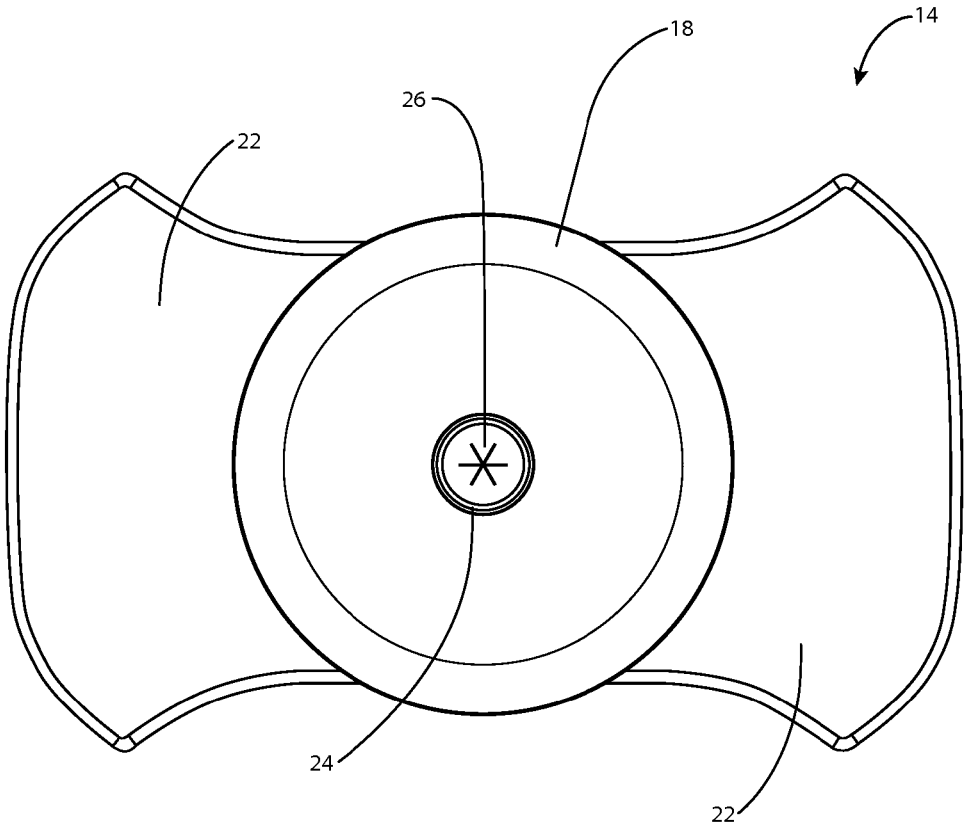
FIG. 3 is a bottom view of the push-pull closure shown in FIG. 2.

FIG. 3 is a bottom view of a push-pull closure 14 of the present invention comprising a base member 22 and slidable cap 18, wherein the slidable cap comprises a dispensing opening 24 covered by a slit valve 26. The slit valve is made of a flexible silicone rubber material.

Figure 4:
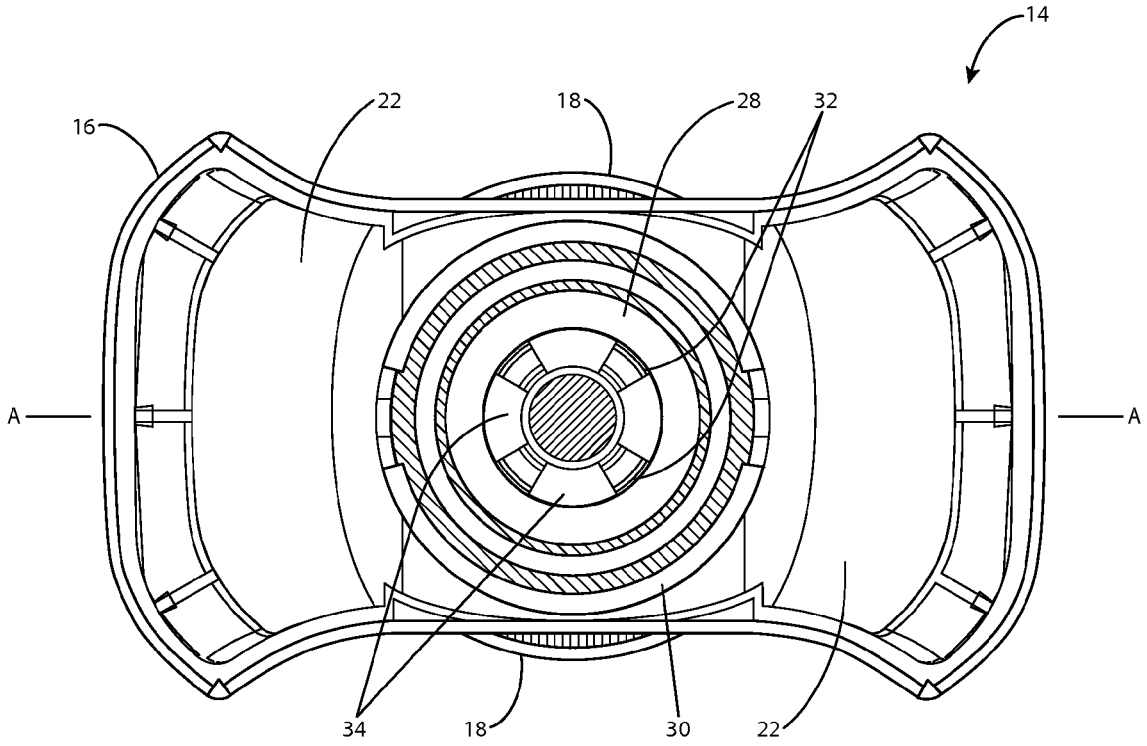
FIG. 4 is a top view of the push-pull closure shown in FIG. 2.

FIG. 4 is a top view of a push-pull closure 14 of the present invention comprising a shroud 16, base member 22, slidable cap 18, diffuser 28, and snap-fit collar 30. The diffuser 28 is in the shape of a funnel and comprises four openings 32 through which the consumer product can flow upon dispensing. The side walls 34 of the diffuser 28 impede the flow of the consumer product and impart shear upon it as the consumer product is being dispensed from the package.

Figure 5:
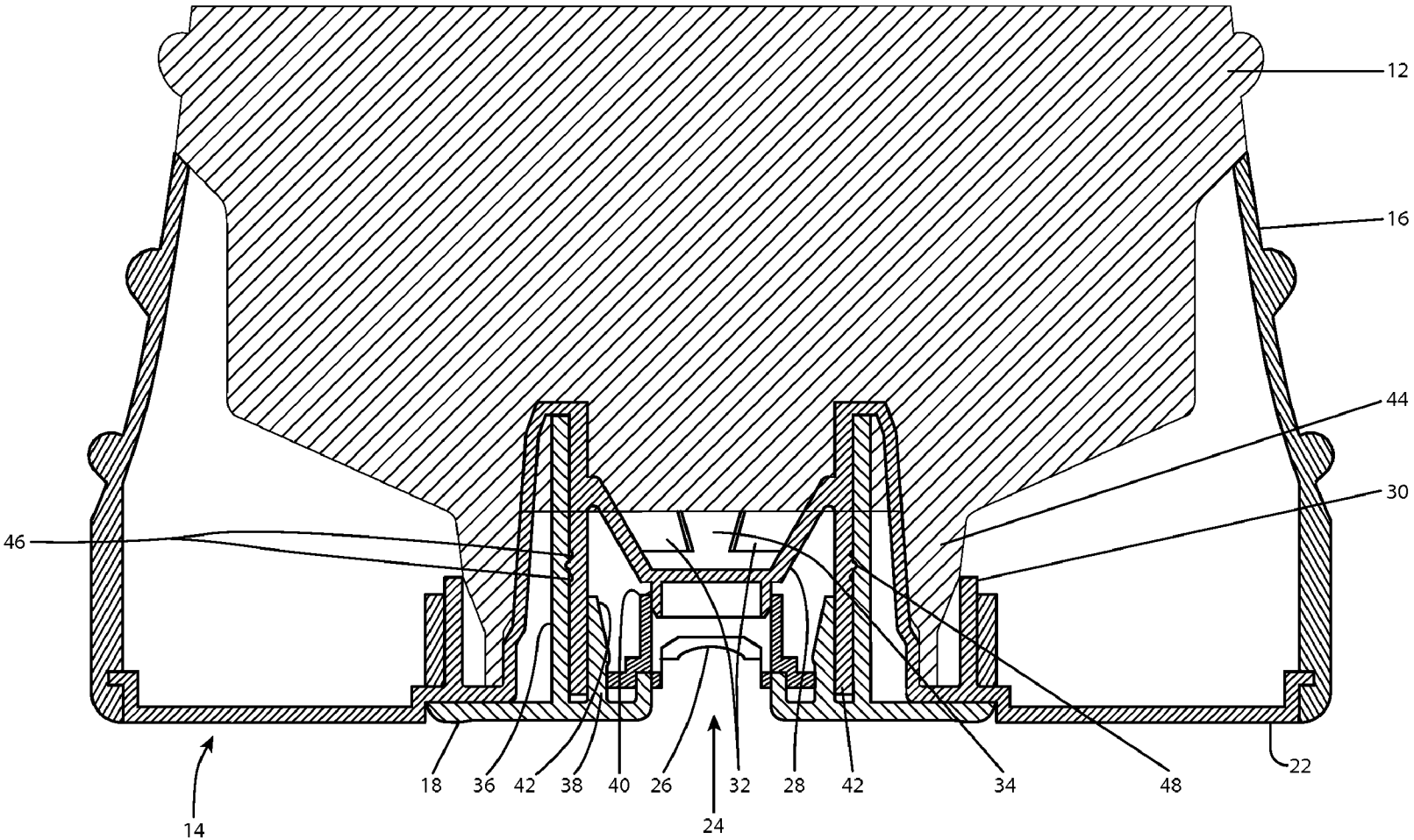
FIG. 5 is a cross-sectional view of the push-pull closure, taken along A-A as shown in FIG. 4.

FIG. 5 is a cross-sectional view of a push-pull closure 14 of the present invention, taken along plane A-A as shown in FIG. 4. The slidable cap 18 comprises a slide column wall 36, a valve housing 38, and a retaining ring 40 that secures a slit valve 26 over the dispensing opening 24 of the slidable cap 18. The base member 22 of the push-pull closure 14 comprises a diffuser 28, a guide wall 42, and a snap-fit collar 30. The snap-fit collar 30 of the base member 22 engages a snap-fit neck 44 of the bottle 12, thereby attaching the push-pull closure 14 to the bottle 12. The slide column wall 36 of the slidable cap 18 engages the guide wall 42 of the base member 22. The guide wall 42 comprises two recessed channels 46 that receive a raised beaded line 48 extending from the inner surface of the slide column wall 36 of the slidable cap 18. As the slide column wall 36 of the slidable cap 18 slides along the guide wall 42 of the base member 22, the raised beaded line 48 can move from one recessed channel 46 to the other, one positioning the slidable cap 18 in a closed position (as shown in FIG. 2) and one positioning the slidable cap 18 in an open position (as shown in FIG. 7). The diffuser 28 comprises side walls 34 and four openings 32 in the side walls 34. The liquid consumer product contained in the bottle 12 will flow through the four openings 32 of the diffuser 28 and, when the slidable cap is in the open position (as shown in FIG. 7), then through the slit valve 26 and out the dispensing opening 24 of the slidable cap 18.

Figure 6:
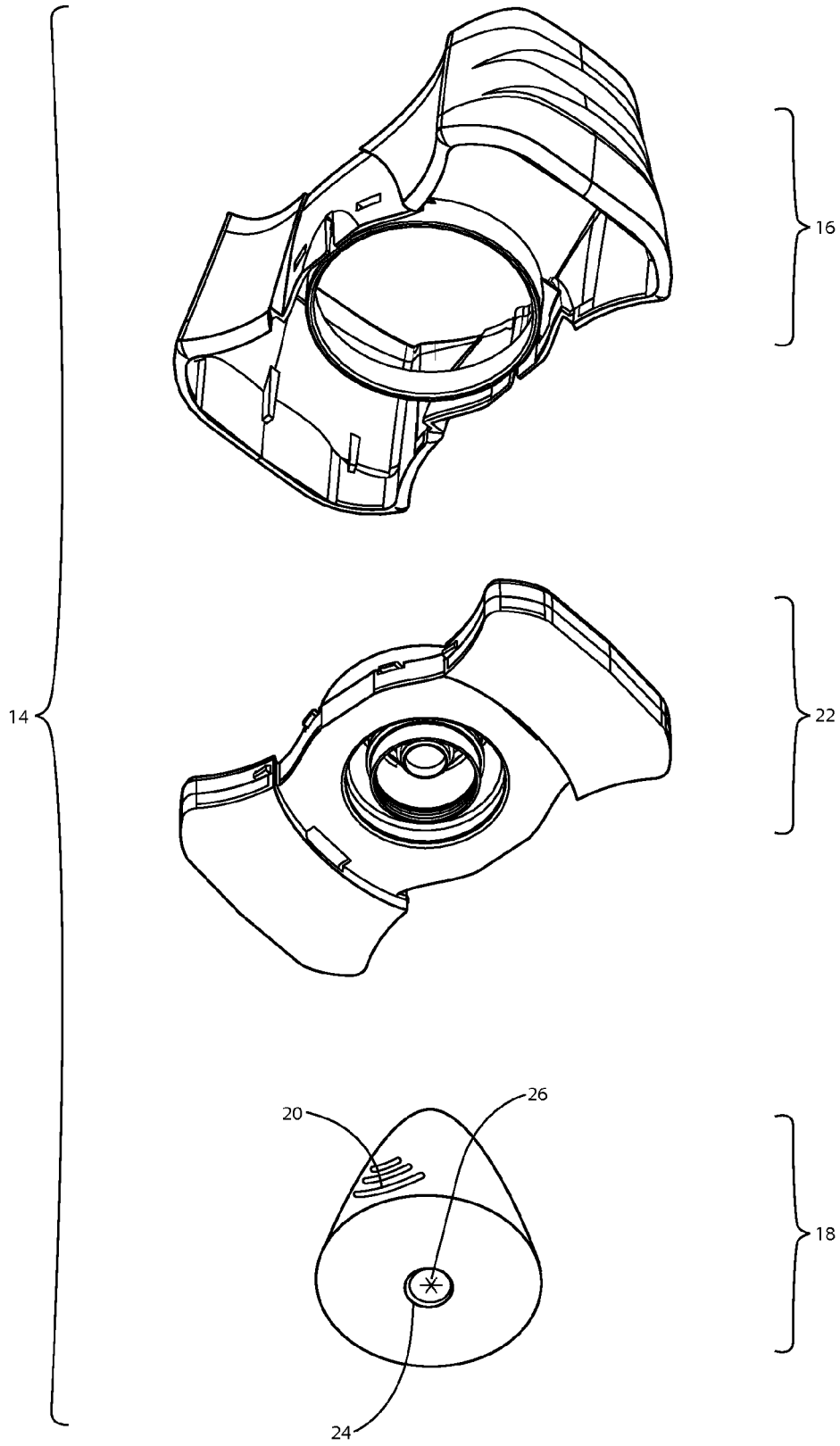
FIG. 6 is an exploded perspective view of the push-pull closure shown in FIG. 2.

FIG. 6 is an exploded perspective view of the push-pull closure of the present invention comprising a shroud 16, a base member 22, and a slidable cap 18. The base member comprises a diffuser 28, a guide wall 42, and a snap-fit collar 30. The shroud 16 comprises a stabilizing ring 50 into which the outer surface of the snap-fit collar 30 of the base member 22 is inserted. The slidable cap 18 comprises a dispensing opening 24 that is covered by a slit valve 26. The slidable cap 18 further comprises a front and a back wall, each being half-oval in shape and having ridges 20 thereon. As shown in FIG. 5, the slidable cap 18 has a slide column wall 36 that engages the guide wall 42 of the base member 22.

FIG. 7 is a front view of a push-pull closure 14 of the present invention comprising a shroud 16 and slidable cap 18, wherein the closure is in an open position.

The package of the present invention can be used to contain a wide variety of consumer products, preferably liquid consumer products. Examples of suitable products to be contained in the present package include body wash, body lotion, shampoo, conditioner, deodorant, shave gel, and other personal care products. Additional suitable products contained in the present package include food condiments such as ketchup, mayonnaise, mustard, and the like.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A package for containing and dispensing a consumer product, said package comprising:

a push-pull closure connected to a bottle and a dispensing opening covered by a slit valve through which said consumer product is dispensed;

wherein said push-pull closure comprises a slidable cap connected to a base member connected to a shroud and wherein said slidable cap comprises said dispensing opening, a slide column wall, a valve housing containing said slit valve, and a retaining ring securing said slit valve in said valve housing;

wherein said base member comprises a diffuser, a snap-fit collar, and a guide wall that engages said slide column wall of said slidable cap; and wherein said shroud comprises a stabilizing ring into which an outer surface of said snap-fit collar of said base member is inserted.

2. A package according to claim 1, wherein the package is a tottle.

3. A package according to claim 1, wherein said diffuser has a funnel shape having a plurality of openings through which said consumer product flows.

4. A package according to claim 1, wherein said slide column wall of said slidable cap comprises a raised bead line and said guide wall of said base member comprises two parallel recessed channels for receiving said raised bead line of said slide column wall of said slidable cap.

5. A package according to claim 1, wherein said package contains a liquid composition.

6. A package according to claim 5, wherein said liquid composition is a shear-thinning composition.

7. A package according to claim 6, wherein said shear-thinning composition is a body wash composition.

* * * * *